US010258117B2

(12) United States Patent
Graber et al.

(10) Patent No.: US 10,258,117 B2
(45) Date of Patent: Apr. 16, 2019

(54) WEARABLE BAND, KIT AND METHOD

(71) Applicants: Stephen M. Graber, Troy, NY (US); Joely M. Graber, Troy, NY (US)

(72) Inventors: Stephen M. Graber, Troy, NY (US); Joely M. Graber, Troy, NY (US)

( * ) Notice: Subject to any disclaimer, the term of this patent is extended or adjusted under 35 U.S.C. 154(b) by 32 days.

(21) Appl. No.: 15/601,627

(22) Filed: May 22, 2017

(65) Prior Publication Data

US 2018/0235326 A1 Aug. 23, 2018

Related U.S. Application Data

(60) Provisional application No. 62/462,541, filed on Feb. 23, 2017.

(51) Int. Cl.

| | |
|---|---|
| ***A44C 5/00*** | (2006.01) |
| ***A44C 15/00*** | (2006.01) |
| *A44C 25/00* | (2006.01) |
| *A44C 5/14* | (2006.01) |
| *A44C 17/02* | (2006.01) |

(52) U.S. Cl.

CPC ..... *A44C 15/0025* (2013.01); *A44C 5/0053* (2013.01); *A44C 5/147* (2013.01); *A44C 17/0241* (2013.01); *A44C 25/007* (2013.01)

(58) Field of Classification Search

CPC ..... A44C 25/00; A44C 25/001; A44C 5/0015; A44C 5/0053; A44C 5/0025; A44C 5/147; A44C 5/04; A44C 25/007

USPC ..... 63/21, 24, 23, 38, 3, 11

See application file for complete search history.

(56) References Cited

U.S. PATENT DOCUMENTS

| | | | | |
|---|---|---|---|---|
| 1,553,198 | A | 9/1925 | Stern | |
| 2,585,183 | A | 2/1952 | Stern | |
| 3,217,514 | A | 11/1965 | Newman | |
| 3,959,989 | A | 6/1976 | Bhandia | |
| 4,970,878 | A | 11/1990 | Lee | |
| 5,515,808 | A * | 5/1996 | Edlund | G10K 5/00 116/137 R |
| 6,164,815 | A | 12/2000 | Degonda | |
| 6,167,726 | B1 | 1/2001 | Kremer | |
| 6,550,276 | B2 | 4/2003 | Frank | |
| 7,296,439 | B2 | 11/2007 | Tanory, Jr. | |
| 2002/0189146 | A1 | 12/2002 | Lyon | |
| 2005/0199000 | A1 | 9/2005 | Grinstead | |
| 2008/0083248 | A1 * | 4/2008 | Wang | A44C 25/001 63/38 |

(Continued)

*Primary Examiner* — Emily M Morgan

(74) *Attorney, Agent, or Firm* — Schmeiser, Olsen & Watts, LLP

(57) ABSTRACT

Disclosed is a wearable band that includes a strap extending between a first end and a second end and an axle extending between and attached to each of the first end and the second end, the axle including a smaller cross section than the strap. The wearable band includes a first disc portion including a first body, a first channel, a first groove and a first protrusion, and a second disc portion including a second body, a second channel, a second groove and a second protrusion. The first disc portion and the second disc portion are connected such that the first protrusion is located within the second groove and the second protrusion is located within the first groove. The first and second channels are aligned, and the axle is located within the aligned first and second channels. A method and kit are further disclosed.

19 Claims, 12 Drawing Sheets

(56) References Cited

U.S. PATENT DOCUMENTS

| | | | | |
|---|---|---|---|---|
| 2009/0038339 | A1* | 2/2009 | Chen | A44C 9/0015 63/15 |
| 2009/0255295 | A1* | 10/2009 | Lane | A44C 5/0053 63/3.1 |
| 2010/0006020 | A1 | 1/2010 | Gillis | |
| 2010/0083698 | A1 | 4/2010 | Secord | |
| 2014/0102138 | A1* | 4/2014 | Azar | A44C 5/12 63/15 |
| 2016/0106186 | A1* | 4/2016 | Noble | A44C 17/0258 63/15 |

* cited by examiner

WEARABLE BAND, KIT AND METHOD

RELATED APPLICATION

This application is a nonprovisional application claiming priority to provisional U.S. Application No. 62/462,541, filed Feb. 23, 2017, the contents of which are incorporated by reference.

FIELD OF TECHNOLOGY

The subject matter disclosed herein relates generally to wearable, reversible devices. More particularly, this subject matter provides for a wrist band having a rotatable disc with two visually distinct sides.

BACKGROUND

It is often the case that referees in sporting events need to determine which team has the next possession in the event of a jump ball quickly and efficiently. Currently, referees in basketball games must rely on a third party on the sideline to track which team has the next possession in the event of a jump ball, or the referee must attempt to track this mentally. This causes the referee to often take his or her attention away from the game, resulting from a break in play and mistakes to be made. Further, items or accessories are worn by all kinds of people having properties that are individually expressive.

Accordingly, a device which would allow referees to easily and efficiently track which team has the next possession in the event of a jump ball by rotating a wearable disc depending on which team had possession, or an accessory having various modes of expression would be well received in the art.

BRIEF DESCRIPTION

According to one embodiment, a wearable band comprises: a strap extending between a first end and a second end; an axle extending between and attached to each of the first end and the second end, the axle including a smaller cross section than the strap; a first disc portion including a first body, the first disc portion having a first channel extending into the first body for receiving the axle, the first disc portion further including a first groove extending into the first body and a first protrusion protruding from the first body, wherein each of the first channel, the first groove and the first protrusion are parallel or substantially parallel; and a second disc portion including a second body, the second disc portion having a second channel extending into the second body for receiving the axle, the second disc portion further including a second groove extending into the second body and a second protrusion protruding from the second body, wherein each of the second channel, the second groove and the second protrusion are parallel or substantially parallel; wherein the first disc portion and the second disc portion are connected such that the first protrusion is located within the second groove and the second protrusion is located within the first groove, and wherein the first and second channels are aligned, and wherein the axle is located within the aligned first and second channels such that the first and second disc portions are configured to rotate around the axle.

According to another embodiment, a wearable band kit comprises: a band that includes: a strap extending between a first end and a second end; and an axle extending between and attached to each of the first end and the second end, the axle including a smaller cross section than the strap; a first disc portion including a first body, the first disc portion having a first channel extending into the first body configured to receive the axle, the first disc portion further including a first groove extending into the first body and a first protrusion protruding from the first body, wherein each of the first channel, the first groove and the first protrusion are parallel or substantially parallel; and a second disc portion including a second body, the second disc portion having a second channel extending into the second body configured to receive the axle, the second disc portion further including a second groove extending into the second body and a second protrusion protruding from the second body, wherein each of the second channel, the second groove and the second protrusion are parallel or substantially parallel; wherein the first disc portion and the second disc portion are configured to be connected such that the first protrusion is located within the second groove and the second protrusion is located within the first groove when the first and second channels are aligned, and wherein the axle is configured to be located within the first and second channels such that the first and second disc portions are configured to rotate around the axle.

According to another embodiment, a method comprises: providing a band that includes: a strap extending between a first end and a second end; and an axle extending between and attached to each of the first end and the second end, the axle including a smaller cross section than the strap; providing a disc that includes: a first disc portion including a first body, the first disc portion having a first channel extending into the first body, the first disc portion further including a first groove extending into the first body and a first protrusion protruding from the first body, wherein each of the first channel, the first groove and the first protrusion are parallel or substantially parallel; and a second disc portion including a second body, the second disc portion having a second channel extending into the second body, the second disc portion further including a second groove extending into the second body and a second protrusion protruding from the second body, wherein each of the second channel, the second groove and the second protrusion are parallel or substantially parallel; sliding the first protrusion within the second groove and the second protrusion in the first groove; connecting the first disc portion and the second disc portion such that the axle is located within the first and second channels; wearing the band with the disc on a wrist of a wearer; and rotating, by the wearer, the disc about the axle to expose the first disc portion or the second disc portion.

BRIEF DESCRIPTION OF THE DRAWINGS

The subject matter which is regarded as the invention is particularly pointed out and distinctly claimed in the claims at the conclusion of the specification. The foregoing and other features and advantages of the invention are apparent from the following detailed description taken in conjunction with the accompanying drawings in which:

DETAILED DESCRIPTION

Figure 1:
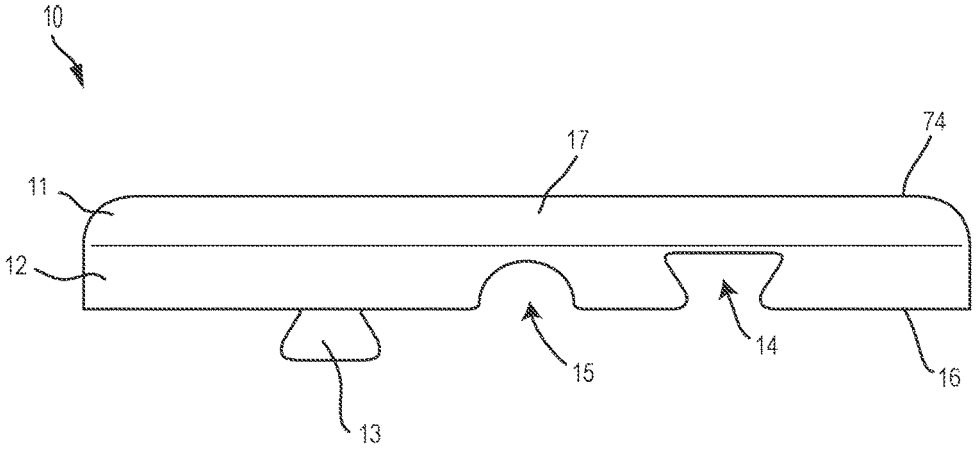
FIG. 1 depicts a side view a disc according to one embodiment.

A detailed description of the hereinafter described embodiments of the disclosed apparatus and method are presented herein by way of exemplification and not limitation with reference to the Figures.

Referring to FIGS. 1-4, there is shown a disc 10 according to one embodiment. A "disc" as defined herein may be flat and cylindrical in shape, but may have various other geometric shapes, for example prisms, cuboids, and the like. The disc 10 may include a body 74. The body 74 of the disc 10 may include two faces: an indicating portion 11 and an interlocking portion 12. The indicating portion 11 may be a first face, and the interlocking portion 12 may be an opposing second face.

The indicating portion 11 and interlocking portion 12 may be made of a plastic material, but may also be made of any other suitable material such that they may be easily manufactured. The indicating portion 11 may be a solid color, but also may have an image, logo, letters, words, or other distinctive indicia on face 17 of indicating portion 11.

The interlocking portion 12 may consist of a protrusion 13 and corresponding groove 14. Protrusion 13 and groove 14 may run parallel (or at least substantially parallel) to each other along face 16 and are spaced and equal distance from the edge of disc 10. Protrusion 13 extends three dimensionally away from face 16. Protrusion 13 begins narrow at face 16 and gradually increases in width as it extends away from face 16 such that the cross-section of protrusion 13 is trapezoidal in shape, with the wider of the parallel sides at the extended point.

Groove 14 extends into disc 10. Groove 14 begins narrow at face 16 and increases in width as it extends into disc 10. Similar to protrusion 13, the cross-section of groove 14 is trapezoidal is shape with the narrower of the parallel sides at face 16. The angle at which protrusion 13 and groove 14 increase in width may be approximately 60 degrees, but may be smaller or larger in order to facilitate stronger connections and manufacturing processes between the protrusion 13 and the face 16, and/or the protrusion 13 and a corresponding groove of another disc (described herein below). Additionally, the cross-sections of protrusion 13 and groove 14 will be substantially similar in size and shape. The cross-sections of protrusion 13 and groove 14 may also be other geometric shapes such as rectangle, circle, and the like.

Figure 2:
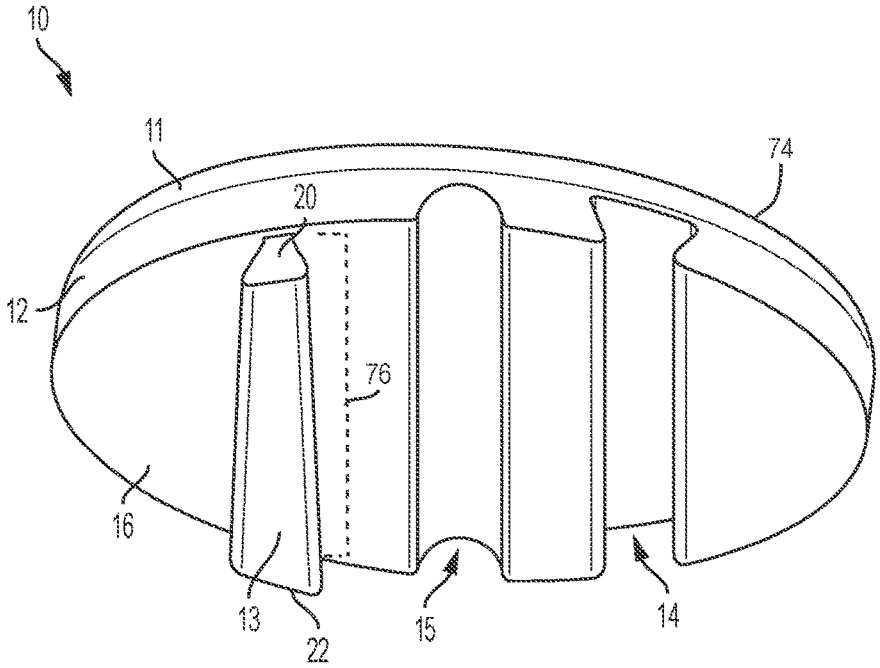
FIG. 2 depicts a perspective view the disc of FIG. 1, according to one embodiment.
Figure 3:
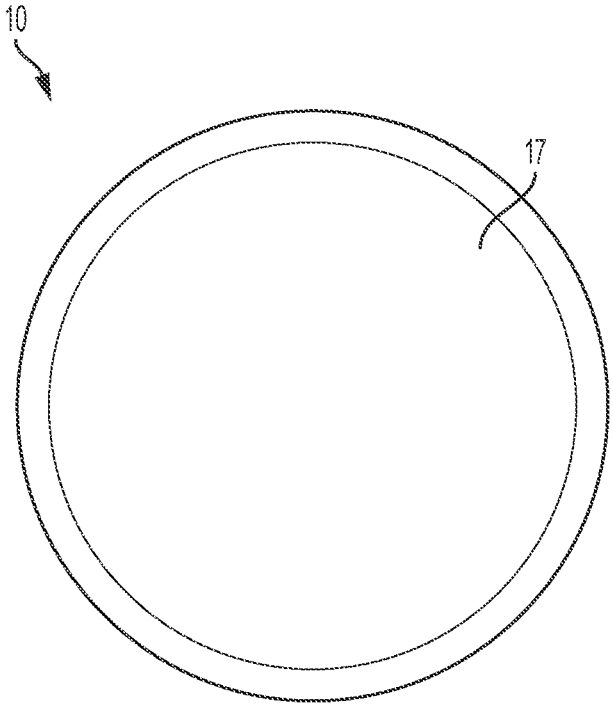
FIG. 3 depicts a top view of the disc of FIGS. 1-2, according to one embodiment.
Figure 4:
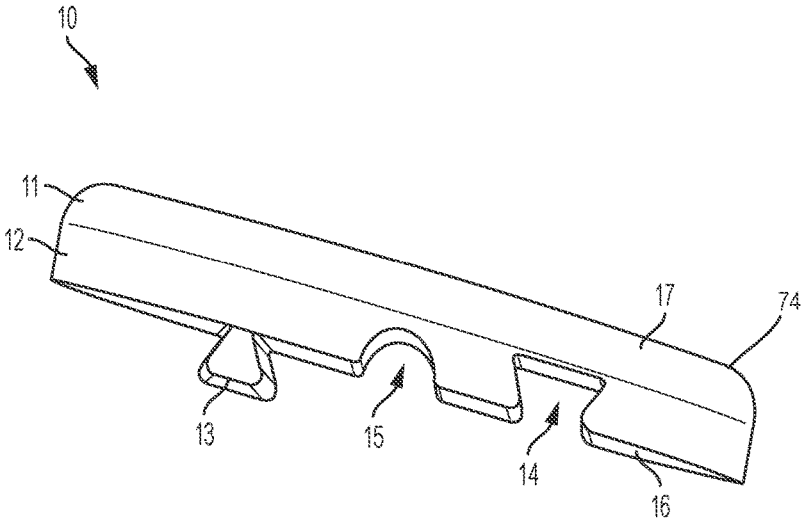
FIG. 4 depicts another perspective view the disc of FIGS. 1-3, according to one embodiment.
Figure 6:
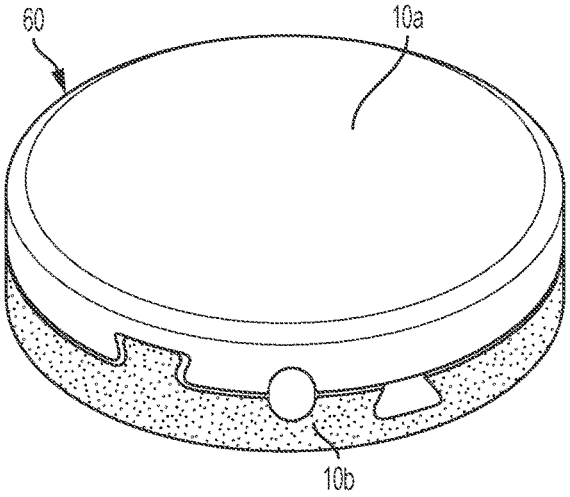
FIG. 6 depicts two of the discs of FIGS. 1-4 attached together according to one embodiment.

As shown in FIG. 2, the protrusion 13 may extend across a width 76 of the body 74 between the first end 20 and the second end 22. The first end 20 of the protrusion 13 may be thinner than the second end 22. This may facilitate ease of sliding the protrusion 13 of one disc 10 into the groove 14 of another disc 10. In other embodiments, the protrusions 13 of the discs 10 may extend consistently across the width of the disc 10 consistently and not have a wider or narrower end. The second end 22 shown may have an interference fit with the consistent width of the groove 14. Thus, when connected (as shown in FIG. 6), the interference or press fit between the second ends 22 and the grooves 14 of each of the two discs 10 may hold the discs 10 together. The grooves 14 may further be channels, trenches, hollows, openings or the like.

Figure 7:
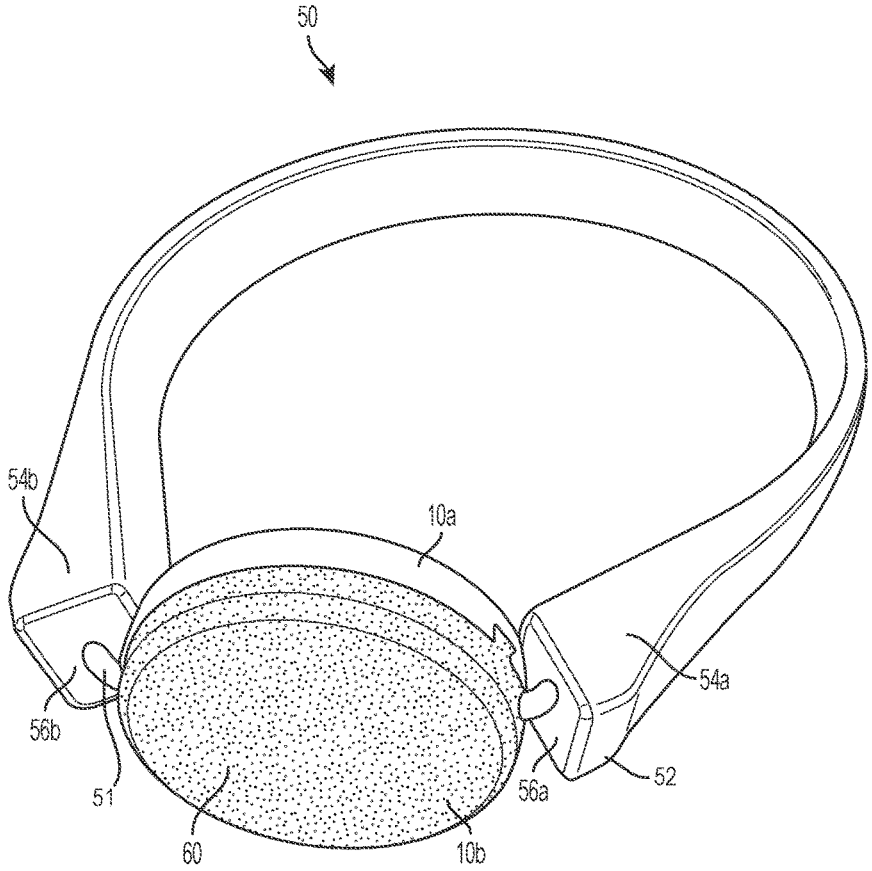
FIG. 7 depicts the wearable band of FIG. 5 with two of the attached discs of FIGS. 1-4 according to one embodiment.

Further, interlocking portion 12 may contain a channel 15. The channel 15 may also run parallel to protrusion 13 and groove 14 along face 16. The channel 15 extends into the disc 10 from the face 16. The cross-section of the channel 15 may be a semicircle or half circular in shape, but may also be any other geometric shape such as a square, rectangle, triangle and the like. As shown in FIG. 7, the channel 15 may be configured to receive a portion of a band. The channel 15 may further be a groove, trench, hollow, opening or the like.

Figure 5:
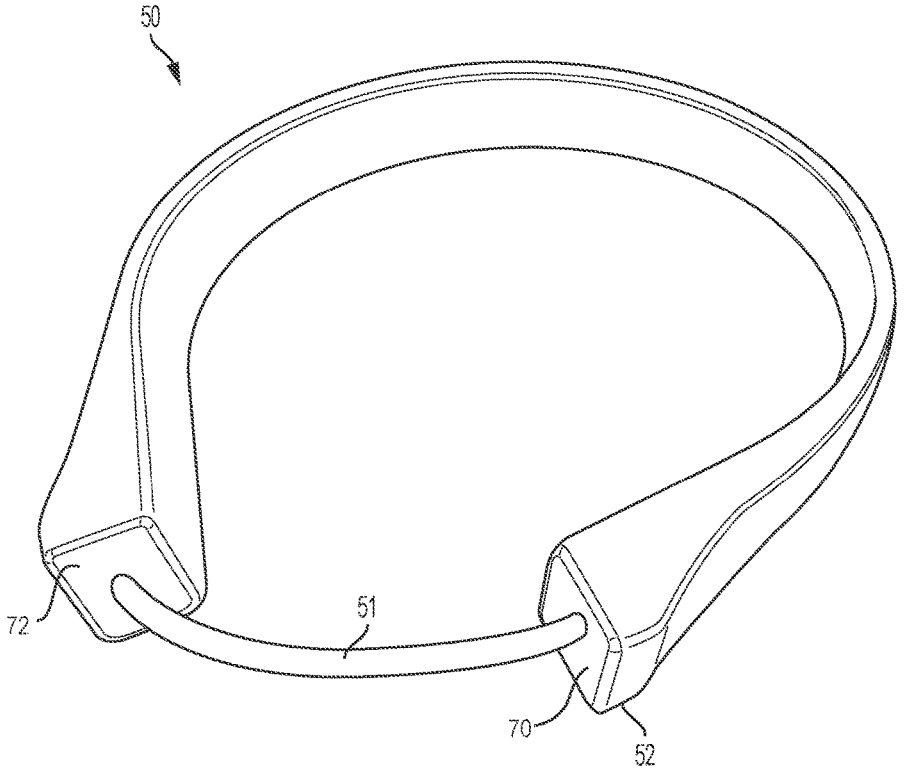
FIG. 5 depicts a wearable band according to one embodiment.

Referring to FIG. 5, there is shown a band 50 according to one embodiment. Band 50 may be made of a flexible material such that it may be worn by a number of users in a "one size fits all" manner. In other embodiments, there may be different size bands 50. For example, a band 50 having the following sizes are contemplated: extra large (XL), large (L), medium (M), small (S) and extra small (XS). Still further, extra extra small (XXS) and extra extra large (XXL) and the like are contemplated.

Band 50 may be a bracelet, wristlet, wristband, anklet, necklace or the like. Band 50 may consist of a strap 52 and an axle 51. Strap 52 may extend between a first end 70 and a second end 72. The strap 52 may be rectangular in cross section, with a width substantially larger than its height; such that it may be a wide, flat strap. However, it should be understood that strap 50 is not limited to being rectangular in shape. The axle 51 extends between and is attached to each of the first end 70 and the second end 72. The axle 51 is shown having a smaller cross section than the strap 52. The cross section of axle 51 will correspond to that of channel 15 in disc 10. For example, if the cross section of channel 15 is a semicircle, the cross section of axle 51 will be a circle such that axle 51 is capable of being placed within channel 15. Additionally, the length of axle 51 will be approximately the same length as the disc 10 such that a single disc 10 may be placed along axle 51 between the end points of strap 52. Thus, the length of the axle 51 may correspond with the diameter of the disc 10.

In the embodiment shown, band 50 may be comprised of a single axle 51 and a single strap 52. In this embodiment, band 50 is shown being capable of supporting a single wearable interconnected disc 60 comprising two of the single discs 10 described above. In other embodiments, band 50 may include a plurality of axles and straps, each axle divided by larger dimensioned stops, such that band 50 is capable of supporting a number of wearable interconnected discs. The interconnected discs may be attachable along one portion of the band, or may be divided across different portions (i.e. one or more on a front side of the band, and one or more on a back side). The band 50 could be a variety of colors or patterns depending on the use and preference of the user. The band 50 may be stretchable in order to be applied to the wrist of a wearer. In particular, one or both of the axle 51 and the strap 52 may be stretchable. In other embodiments, the band 50 may be configured to have a release or detachment mechanism to allow for the band to be worn.

A wearable interconnected disc 60 may be obtained by combining two desired versions of disc 10*a*, 10*b*, as shown in FIG. 6. The two versions of disc 10*a*, 10*b* may be secured together through the corresponding protrusion 13 and groove 14. To accomplish this, the protrusion 13 of the first disc 10*a* may be slid into the groove 14 of the second disc 10*b*, at the same time the protrusion 13 of the second disc 10*b* is slid into the groove 14 of the first disc 10*a*. In one embodiment (not shown), the wider end of protrusion 13 may correspond to the wider end of grove 14, with both cross sections narrowing as the approach face 16, similar to a dovetail joint, requiring two differently molded or shaped discs for attachment. In the embodiment shown, the wider protrusion end 22 of a first disc 10*a* is inserted into the channel 14 of a second disc 10*b*, while the narrower protrusion end 20 of the second disc 10*b* is inserted into the channel 14 of the first disc 10*a*. This arrangement may prevent the two versions of disc 10*a*, 10*b* from pulling apart and separating when worn. When combined together, the two versions of disc 10*a*, 10*b* will form a solid three dimensional wearable interconnected disc 60. The channel 15 of the first and second disc 10*a*, 10*b* will also align, forming a bore through the middle of the wearable interconnected disc 60. The shape of this bore will correspond to the cross section of axle 51, such that axle 51 may run through the bore. In one embodiment, the axle 51 is made of a stretchable material such that when the channel 15 of the first and second discs 10*a*, 10*b* are combined and align, the dimensions of the combined channels 15 are smaller than the dimensions of the axle 51 when the axle 51 is in an unstretched state. In contrast, the combined channels 15 are dimensioned to be larger than the dimensions of the axle 51 when the axle 51 is in a stretched state.

Figure 8:
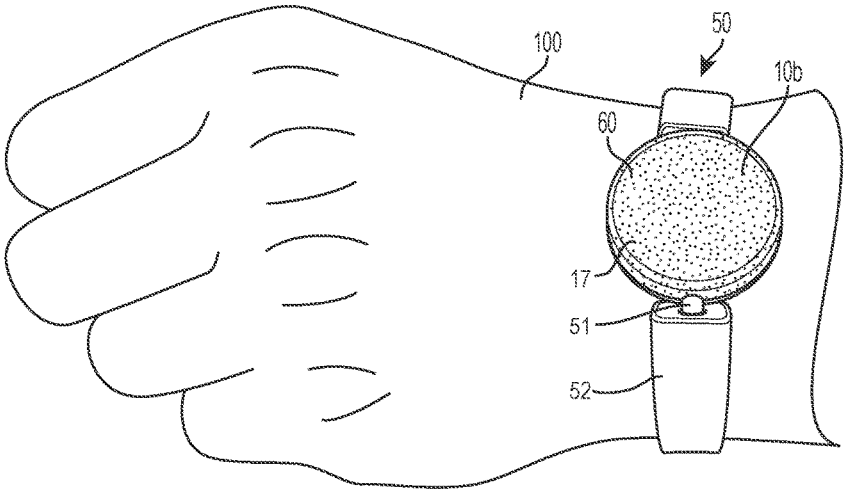
FIG. 8 depicts the wearable band with the two attached discs of FIG. 7 being worn by a wearer according to one embodiment.
Figure 9:
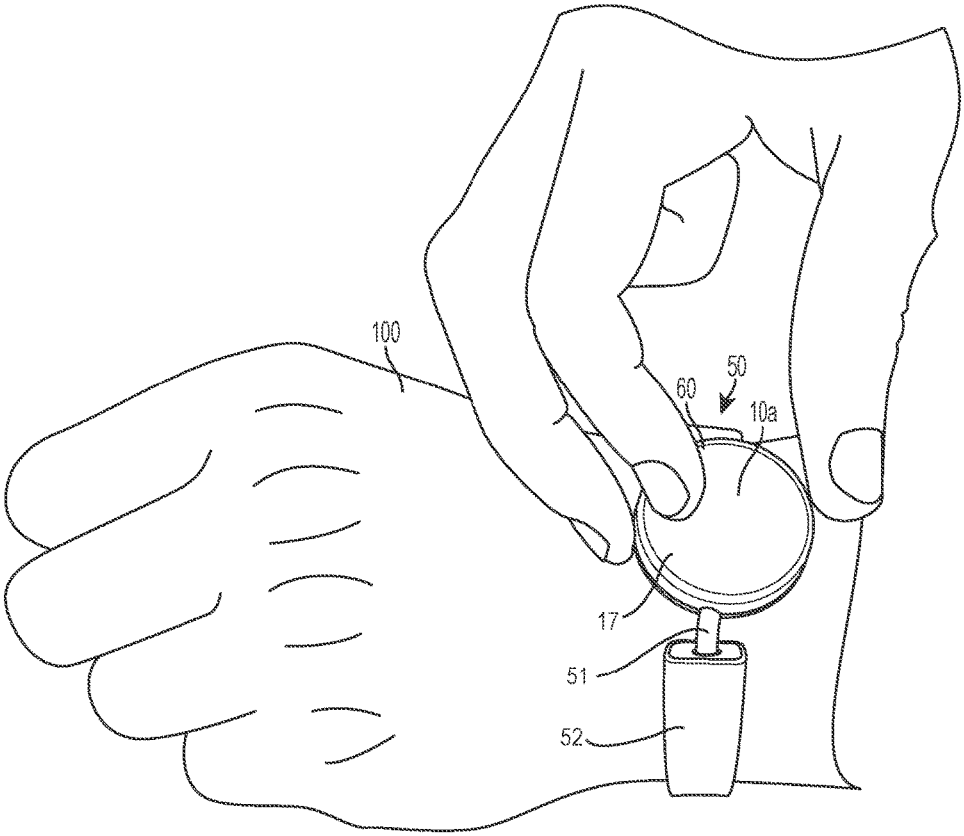
FIG. 9 depicts the wearable band with the two attached discs of FIGS. 7-8 being worn by a wearer according to one embodiment.

As shown in FIGS. 7-9, to be worn on the body, the wearable interconnected disc 60 is combined in the manner described herein, with the bore placed around an axle 51 of a band 50. As axle 51 is approximately the same length as disc 10, when placed on axle 51 the two versions of disc 10*a*, 10*b* will be unable to slide apart due to the wider end points of strap 52. This will allow the wearable interconnected disc 60 to be rotated around the fixed axis of axle 51 while being worn on the body via band 50. Further, the band 50 may have thickened portions 54*a*, 54*b*. The thickened portions 54*a*, 54*b* may have a thick cross sectional area to prevent the interconnected disc from slipping apart and unattaching into its two individual discs 10*a*, 10*b*. The thickened portions 54*a*, 54*b* may include a first face 56*a* and a second face 56*b* acting as a stop to prevent the interconnected disc 60 from moving or unattaching.

In one embodiment, the band 50 and wearable interconnected disc 60 may be worn on the wrist of a wearer 100, as shown in FIG. 8-9. The wearable interconnected disc 60 may be positioned such that face 17 of the first disc 10*a* is facing outward, away from the wrist of the wearer 100, with face 17 of the second disc 10*b* facing inward, against the skin of the wearer 100, as shown in FIG. 9. Alternatively, the wearable interconnected disc 60 may be positioned such that the face 17 of the second disc 10*b* is facing outward, away from the wrist of the wearer 100, with the face 17 of the first disc 10*a* facing inward, against the skin of the wearer 100, as shown in FIG. 8. In this way, the user may rotate the wearable interconnected disc 60 about axle 51 to display the preferred disc 10 from the two visually distinct discs comprising the wearable interconnected disc 60.

The two visually distinct versions of discs 10*a*, 10*b* may be chosen by the user for a number of applications. For example, in one embodiment, a referee of a sporting event, such as basketball, may choose discs which match the two colors of team uniforms, or the two team's logo or team names. For example, if a first team wears white uniforms and is competing against a second team wearing blue uniforms, the referee may choose a first disc 10 which is white and a second disc 10 which is blue and combine them in the way described herein. The referee would then be able to easily track possession by turning the wearable disc to display the color of the team that will get next possession in the event of a jump ball. For example, when the first team has the next possession, the referee would turn the disc so that the white disc is facing outward. When the next team to get possession in the event of a jump ball changes to the second team, the referee would then turn the wearable disc so that the blue disc is facing outward. This allows the referee to easily track who is entitled to the next possession in the event of a jump ball without having to take his or her attention away from the game. It also easily allows the referee to quickly determine which team has next possession in the event of a jump ball without having to consult with a third party or cause a break in play of the game. In one embodiment, a referee may look at the wearable interconnected disc 60 at the same time the referee is indicating a jump ball by placing his or her hands, with thumbs up, directly in front of the head of the referee where the wearable interconnected disc 60 is visible.

In another embodiment, the wearable interconnected disc 60 may be used to convey a message. For example, a first disc could be chosen which is green and combined with a second disc which is red. The green side of the disc could convey "yes" or "go" and the red side could convey "no" or "stop." Words or letters could also be placed on each disc to convey a message. For example, the letter "L" could be displayed on the first disc to indicate "Left" and an "R" could be displayed on the second disc to indicate "Right" and vice versa.

In yet another embodiment, the discs may feature images or characters from popular television programs for children. Children may collect discs with their favorite images and display them, combining characters or symbols in different ways. It should be understood that there are a vast number of applications for a wearable, reversible disc and the embodiments described hereinabove should not be understood to be limiting and are provided for exemplary purposes only.

Figure 10:
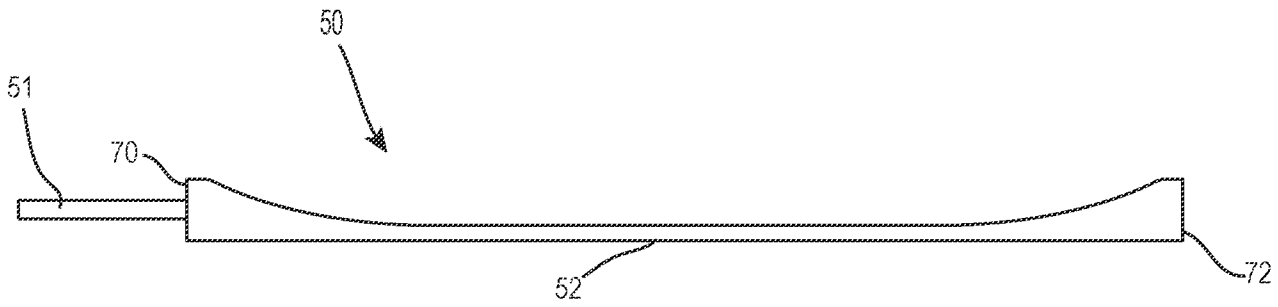
FIG. 10 depicts a schematic showing the wearable band of FIG. 5 according to one embodiment.
Figure 11A:
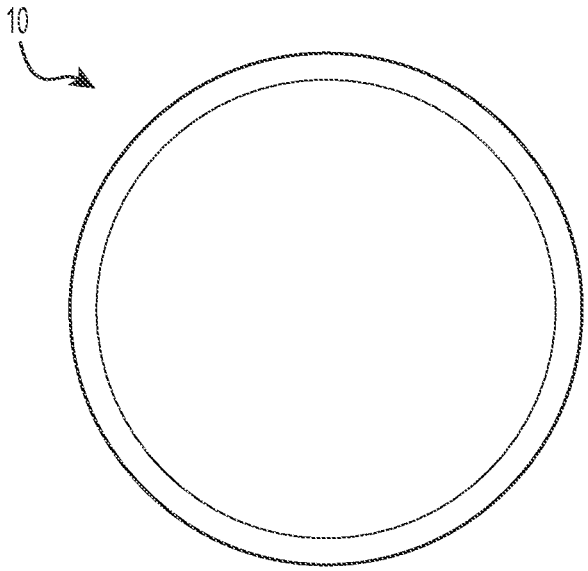
FIG. 11A depicts a top view of the disc of FIGS. 1-4 according to one embodiment.
Figure 11B:
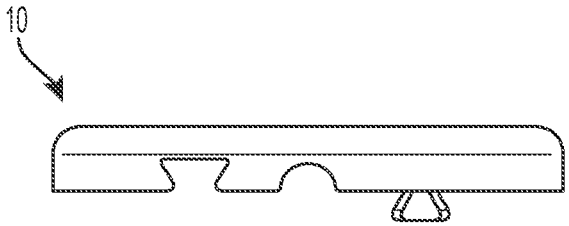
FIG. 11B depicts a left side view of the disc of FIGS. 1-4 according to one embodiment.
Figure 11C:
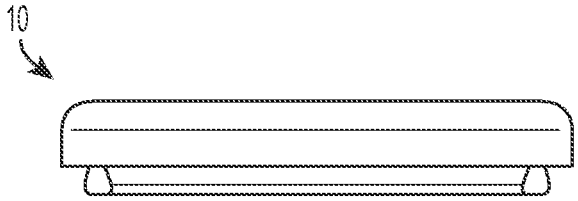
FIG. 11C depicts a front view of the disc of FIGS. 1-4 according to one embodiment.
Figure 11D:
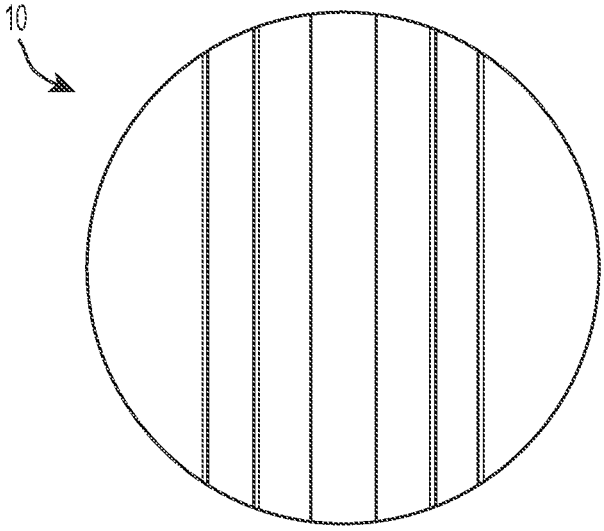
FIG. 11D depicts a bottom view of the disc of FIGS. 1-4 according to one embodiment.
Figure 11E:
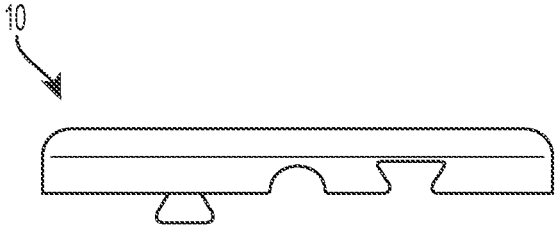
FIG. 11E depicts a right side view of the disc of FIGS. 1-4 according to one embodiment.
Figure 11F:
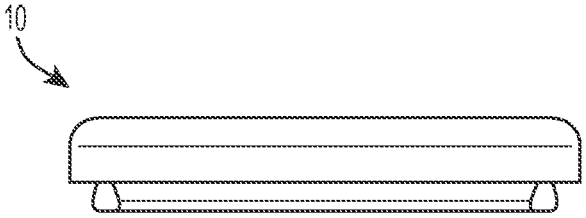
FIG. 11F depicts a back view of the disc of FIGS. 1-4 according to one embodiment.

Shown in FIG. 10 is a version of the band 50 in accordance with one embodiment. In the embodiment shown, the axle 51 has not yet been connected to the second end 72 of the strap 52. The axle 51 may be fashioned in the manner shown in FIG. 10 and then connected with an adhesive or through a heat process for melting the axle 51 to the strap 52. The second end 72 may be fabricated with an opening through which to receive the axle 51 prior to the heat process. Other attachment processes are contemplated for attaching the axle 51 to the strap 52. It should be understood that the strap 52 of the band 50 is not limited to having a single axle 51; in yet another embodiment, the strap 52 may have a plurality of axles, such that more than one disc 10 could be attached to the strap 52 at one time, at any portion of the strap 52 having an axle 51.

Similarly, FIGS. 11A, 11B, 11C, 11D, 11E and 11F show a version of the disc 10 having exemplary dimensions in accordance with one embodiment. While the embodiment shown has been found to be advantageous, other embodiments having alternative dimensions are contemplated.

In still another embodiment, a kit is contemplated which may be provided with the band 50, including the strap 52 and the axle 51. Further, the kit may include a plurality of the discs 10. For example, two of the discs 10 may be provided. In other embodiments, a third, fourth, fifth, sixth, seventh, eighth, ninth and/or tenth disc, etc., may be provided. Each of the various discs provided in the kit may be entirely made of a unique color.

In still another embodiment a method is contemplated. The method may include providing a band, such as the band 50, and a plurality of discs, such as the discs 10. The method may include attaching, by sliding two discs together, or otherwise connecting two discs together at axle 51. The method is not limited to connecting discs together at a single axle 51, for example, the strap 52 could have a plurality of axles such that discs could attach to the strap 52 along multiple portions thereof where axles are located. The method may include wearing the band on a wrist of a wearer, such as the wearer 100. The method may include orienting the discs, by the wearer, such that a first disc of the two discs is exposed while a second disc of the two discs is proximate or facing the skin of the wearer. The method may further include orienting the discs, by the wearer, such that the second of the two discs is exposed and the first of the two discs is proximate or facing the skin of the wearer. This may include rotating, by the wearer, the discs about the axle. The axle may be made of a stretchable material, and the method may include stretching, by the wearer, the axle during the rotating of the discs. The method may include holding, by the wearer, a basketball with a first hand on the wrist during the rotating, wherein the rotating is accomplished with a second hand of the wearer. The method may include exposing a first color of a first disc and then may include exposing a second color of the second disc that is visually distinct from the first color. The method may include making, by the wearer, a jump ball hand signal, and visually detecting the first color of the first disc portion, by the wearer, while making the jump ball hand signal. The method may include attaching, by sliding, two additional discs together at a second axle on the band 50 wherein the second axle is at an opposite circumferential location along the band from a first axle.

Elements of the embodiments have been introduced with either the articles "a" or "an." The articles are intended to mean that there are one or more of the elements. The terms "including" and "having" and their derivatives are intended to be inclusive such that there may be additional elements other than the elements listed. The conjunction "or" when used with a list of at least two terms is intended to mean any term or combination of terms. The terms "first" and "second" are used to distinguish elements and are not used to denote a particular order.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims. Moreover, it should be understood that the present invention may include any combination of the components, hierarchy and methodology described herein.

What is claimed is:

1. A wearable band comprising:

a strap extending in length from a first end to a second end, wherein the strap is formed of a flexible material;

an axle extending between and attached to each of the first end and the second end, the axle including a smaller cross section than the strap, wherein the axle connects the first end to the second end to form a single loop;

a first disc portion, the first disc portion having a first channel for receiving the axle, the first disc portion further including a first groove and a first protrusion, wherein each of the first channel, the first groove and the first protrusion are parallel or substantially parallel and extend across an entire width of an interlocking face of the first disc portion; and a second disc portion, the second disc portion having a second channel for receiving the axle, the second disc portion further including a second groove, wherein each of the second channel, the second groove and the second protrusion are parallel or substantially parallel and extend across an entire width of an interlocking face of the second disc portion;

wherein the first disc portion and the second disc portion are connected such that the first protrusion is located within the second groove and the second protrusion is located within the first groove, and wherein the first and second channels are aligned, wherein the axle is located within the aligned first and second channels such that the first and second disc portions are configured to rotate around the axle, and wherein the flexible material forming the strap widens in dimension at the first end to form a first face and the second end to form a second face, wherein each of the first face and the second face hold the first and second disc portions together on the axle.

2. The wearable band of claim 1, wherein the axle is made of a stretchable material, wherein the first and second channels combined are dimensioned to be smaller than the dimension of the axle when the axle is in an unstretched state, and wherein the first and second channels combined are dimensioned to be larger than the dimension of the axle when the axle is in a stretched state.

3. The wearable band of claim 1, wherein the strap extends between the first end and second end in substantially a plane; and wherein the axle extends between the first end and second end in substantially the same plane to form the single loop.

4. The wearable band of claim 1, wherein the first protrusion is trapezoidal in shape and has a narrower side proximate the first disc portion, and wherein the second protrusion is trapezoidal in shape and has a narrower side proximate the second disc portion, and wherein the first groove is trapezoidal in shape that widens as the first groove extends into the first disc portion, and wherein the second groove is trapezoidal in shape that widens as the second groove extends into the second disc portion.

5. The wearable band of claim 1, wherein the axle has a circular cross section extending between the first and second ends, and wherein each of the first and second channels are semi-circular in shape.

6. The wearable band of claim 4, wherein the first protrusion extends across a width of the first disc portion between a first end and a second end, and wherein the first protrusion is thicker at the first end relative to the second end, and wherein the second protrusion extends across a width of the second disc portion between a first end and a second end, and wherein the second protrusion is thicker at the first end relative to the second end.

7. The wearable band of claim 1, wherein a length of the axle corresponds to a diameter of each of the first and second disc portions.

8. The wearable band of claim 1, wherein the first disc portion includes a flat face opposed to a surface upon which the first channel, the first groove and the first protrusion are located, wherein the second disc portion includes a flat face opposed to a surface upon which the second channel, the second groove, and the second protrusion are located.

9. A wearable band kit comprising:

a band that includes:

a strap extending in length from a first end to a second end, wherein the strap is formed of a flexible material; and an axle extending between and attached to each of the first end and the second end, the axle including a smaller cross section than the strap, wherein the axle connects the first end to the second end to form a single loop;

a first disc portion, the first disc portion having a first channel configured to receive the axle, the first disc portion further including a first groove and a first protrusion, wherein each of the first channel, the first groove and the first protrusion are parallel or substantially parallel and extend across an entire width of an interlocking face of the first disc portion; and a second disc portion, the second disc portion having a second channel configured to receive the axle, the second disc portion further including a second groove and a second protrusion, wherein each of the second channel, the second groove and the second protrusion are parallel or substantially parallel and extend across an entire width of an interlocking face of the second disc portion, wherein the first disc portion and the second disc portion are configured to be connected such that the first protrusion is located within the second groove and the second protrusion is located within the first groove when the first and second channels are aligned, wherein the axle is configured to be located within the first and second channels such that the first and second disc portions are configured to rotate around the axle, and wherein the flexible material forming the strap widens in dimension at the first end to a first face and the second end to a second face, wherein each of the first face and the second face are configured to hold the first and second disc portions together on the axle.

10. The wearable band kit of claim 9, further comprising a third disc portion, the third disc portion having a third channel configured to receive the axle, the third disc portion further including a third groove and a third protrusion, wherein each of the third channel, the third groove and the third protrusion are parallel or substantially parallel; and a fourth disc portion, the fourth disc portion having a fourth channel configured to receive the axle, the fourth disc portion further including a fourth groove and a fourth protrusion, wherein each of the fourth channel, the fourth groove and the fourth protrusion are parallel or substantially parallel.

11. The wearable band kit of claim 9, wherein the axle is made of a stretchable material, wherein the first and second channels, when aligned, are dimensioned to be smaller than the dimension of the axle when the axle is in an unstretched state, and wherein the first and second channels, when aligned, are dimensioned to be larger than the dimension of the axle when the axle is in a stretched state.

12. The wearable band kit of claim 9, wherein the strap extends between the first end and second end in substantially a plane; and wherein the axle extends between the first end and second end in substantially the same plane to form the single loop.

13. The wearable band kit of claim 9, wherein the first protrusion is trapezoidal in shape and has a narrower side proximate the first disc portion, and wherein the second protrusion is trapezoidal in shape and has a narrower side proximate the second disc portion, and wherein the first groove is trapezoidal in shape that widens as the first groove extends into the first disc portion, and wherein the second groove is trapezoidal in shape that widens as the second groove extends into the second disc portion.

14. The wearable band kit of claim 9, wherein the first protrusion extends across a width of the first disc portion between a first end and a second end, and wherein the first protrusion is thicker at the first end relative to the second end, and wherein the second protrusion extends across a width of the second disc portion between a first end and a second end, and wherein the second protrusion is thicker at the first end relative to the second end.

15. A method comprising:

providing a band that includes:

a strap extending in length from a first end to a second end, wherein the strap is formed of a flexible material; and an axle extending between and attached to each of the first end and the second end, the axle including a smaller cross section than the strap, wherein the axle connects the first end to the second to form a single loop;

providing a disc that includes:

a first disc portion, the first disc portion having a first channel, the first disc portion further including a first groove and a first protrusion, wherein each of the first channel, the first groove and the first protrusion are parallel or substantially parallel and extend across an entire width of an interlocking face of the first disc portion; and a second disc portion, the second disc portion having a second channel, the second disc portion further including a second groove and a second protrusion, wherein each of the second channel, the second groove and the second protrusion are parallel or substantially parallel and extend across an entire width of an interlocking face of the first disc portion;

wherein the flexible material forming the strap widens in dimension at the first end to form a first face and the second end to form a second face, wherein each of the first face and the second face hold the first and second disc portions together on the axle;

sliding the first protrusion within the second groove and the second protrusion in the first groove;

connecting the first disc portion and the second disc portion such that the axle is located within the first and second channels;

wearing the band with the disc on a wrist of a wearer;

rotating, by the wearer, the disc about the axle to expose the first disc portion or the second disc portion, wherein the disc is retained such that the exposed disc portion remains exposed;

making, by the wearer, a jump ball hand signal; and visually detecting the color of the exposed disc portion, by the wearer, while making the jump ball hand signal.

16. The method of claim 15, wherein the axle is made of a stretchable material wherein the first and second channels combined are dimensioned to be smaller than the dimension of the axle when the axle is in an unstretched state, and wherein the first and second channels combined are dimensioned to be larger than the dimension of the axle when the axle is in a stretched state, the method further comprising:

stretching, by the wearer, the axle during the rotating the disc.

17. The method of claim 15, further comprising holding, by the wearer, a basketball with a first hand on the wrist during the rotating, wherein the rotating is accomplished with a second hand of the wearer.

18. The method of claim 15, further comprising:

exposing a first color of the first disc portion, and further comprising exposing a second color of the second disc portion that is visually distinct from the first color.

19. The method of claim 15, wherein the strap extends between the first end and second end in substantially a plane and wherein the axle extends between the first end and second end in substantially the same plane to form the single loop.

* * * * *